US007833041B2

(12) United States Patent
Ono et al.

(10) Patent No.: US 7,833,041 B2
(45) Date of Patent: Nov. 16, 2010

(54) CONNECTOR WITH A FLEXIBLE PRINTED CIRCUIT BOARD

(75) Inventors: Masahiro Ono, Okayama (JP); Masayuki Okamoto, Okayama (JP)

(73) Assignee: OMRON Corporation, Kyoto-shi, Kyoto (JP)

( * ) Notice: Subject to any disclaimer, the term of this patent is extended or adjusted under 35 U.S.C. 154(b) by 58 days.

(21) Appl. No.: 12/421,450

(22) Filed: Apr. 9, 2009

(65) Prior Publication Data

US 2009/0269959 A1 Oct. 29, 2009

(30) Foreign Application Priority Data

Apr. 25, 2008 (JP) ..... 2008-115616

(51) Int. Cl.
*H01R 13/62* (2006.01)

(52) U.S. Cl. ..... 439/329

(58) Field of Classification Search ..... 439/329, 439/260, 495, 607.01, 267, 357
See application file for complete search history.

(56) References Cited

U.S. PATENT DOCUMENTS 6,056,572 A * 5/2000 Matsumoto et al. ..... 439/260
6,431,897 B1 * 8/2002 Hashiguchi et al. ..... 439/267
6,679,713 B2 * 1/2004 Miura ..... 439/260
6,851,968 B2 * 2/2005 Tsunematsu ..... 439/495
7,261,589 B2 * 8/2007 Gillespie et al. ..... 439/495
7,270,567 B2 * 9/2007 Inoue ..... 439/495
7,361,048 B2 * 4/2008 Shimada ..... 439/492
7,367,837 B2 * 5/2008 Pabst ..... 439/460
7,491,088 B2 * 2/2009 Suzuki et al. ..... 439/607.01
7,614,898 B2 * 11/2009 Lee et al. ..... 439/260
7,628,642 B2 * 12/2009 Chen et al. ..... 439/495
7,726,995 B2 * 6/2010 Suzuki et al. ..... 439/260

FOREIGN PATENT DOCUMENTS

JP 2004-071160 A 3/2004

* cited by examiner

*Primary Examiner*—Jean F Duverne
(74) *Attorney, Agent, or Firm*—Osha • Liang LLP

(57) ABSTRACT

A connector has a base having an opening to be inserted with a tip portion of a flexible printed circuit board at a front surface, and having a plurality of insertion holes passing from the front surface to a rear surface juxtaposed at a predetermined pitch, a connection terminal arranged in a projecting manner with a substantially T-shaped operating piece having at one end a movable contacting point that comes into pressure contact with joints juxtaposed at the tip portion of the flexible printed circuit board, the connection terminal having one end that becomes a fixed contacting point inserted to the insertion hole from the rear surface side, and an operating lever in which a cam portion is fitted into a turning recessed portion arranged at an upper side of the connection terminal to act as a turning supporting point, the cam portion driving an operation receiving portion positioned at the other end of the operating piece. A position regulation contacting portion arranged at a lower surface of the operating lever locks to a slip-out preventing projection arranged in a projecting manner at an upper side of the connection terminal to prevent slip-out when the operating lever is turned and a locking operation is completed.

11 Claims, 15 Drawing Sheets

CONNECTOR WITH A FLEXIBLE PRINTED CIRCUIT BOARD

BACKGROUND OF THE INVENTION

1. Technical Field

The present invention relates to connectors, and in particular, to a connector to connect to a joint arranged at a tip portion of a flexible printed circuit board.

2. Related Art

Conventionally, a connector removably fitted to a flexible printed circuit board (FPC) or a flexible flat cable (FFC) has been known, as described in Japanese Unexamined Patent Publication No. 2004-71160. The connector includes a required number of contacts having a contacting portion that contacts with the flexible printed circuit board or the flexible flat cable, a housing having a fit-in port at which the contact is held and fixed and to which the flexible printed circuit board or the flexible flat cable is inserted, and a slider for pushing the flexible printed circuit board (FPC) or the flexible flat cable (FFC) to the contact.

In such a connector, an elastic portion and a supporting point portion are arranged between the contacting portion and the joint of the contact, the contacting portion, the elastic portion, the supporting point portion, and the joint being arranged in a substantially crank-shape; and a push-receiving portion arranged extending from the elastic portion is arranged at a position facing the joint; a pushing portion connecting in the longitudinal direction is arranged on the slider; and the pushing portion attaches the slider to the housing in a freely turning manner between the joint and the push-receiving portion of the contact.

SUMMARY

However, in the above-described connector, if an operating lever, which is a slider 16, is turned to lock when connecting an FPC 40, as shown in FIGS. 2A and 2B of Japanese Unexamined Patent Publication No. 2004-71160, the horizontal component force of the turning operational force is applied. Thus, the operating lever easily drops from a base, which is a housing 12. In particular, when the operating lever drops, stress tends to easily concentrate at a supporting point portion 32 of a contact 14, an elastic portion 34 plastically deforms, and connection may not be possible.

The present invention has been devised to solve the problems described above, and an object thereof is to provide a connector in which the operating lever does not drop from the base and the connection terminal does not plastically deform even if the horizontal component force of the turning operational force acts on the operating lever.

In accordance with one aspect of the present invention, in order to solve the above problems, a connector according to the present invention includes a base having an opening to be inserted with a tip portion of a flexible printed circuit board at a front surface, and having a plurality of insertion holes passing from the front surface to a rear surface juxtaposed at a predetermined pitch; a connection terminal arranged in a projecting manner with a substantially T-shaped operating piece having at one end a movable contacting point that comes into pressure contact with joints juxtaposed at the tip portion of the flexible printed circuit board, the connection terminal having one end that becomes a fixed contacting point inserted to the insertion hole from the rear surface side; and an operating lever in which a cam portion is fitted into a turning recessed portion arranged at an upper side of the connection terminal to act as a turning supporting point, the cam portion driving an operation receiving portion positioned at the other end of the operating piece; wherein a position regulation contacting portion arranged at a lower surface of the operating lever locks to a slip-out preventing projection arranged in a projecting manner at an upper side of the connection terminal to prevent slip-out when the operating lever is turned and a locking operation is completed.

According to the present invention, when the operating lever is locking operated, the operating lever does not drop even if the horizontal component force of the turning operation force acts on the operating lever as the position regulation contacting portion arranged at the operating lever locks to the slip-out preventing projection arranged at the upper side of the connection terminal to prevent slip-out.

Since the operating lever does not slip out in the horizontal direction, excessive load does not act on the connection terminal, and plastic deformation of the connection terminal can be prevented.

Furthermore, the position regulation contacting portion of the operating lever is position regulated at the slip-out preventing projection of the connection terminal, whereby the positioning accuracy of the operating lever when the locking operation is completed increases and the positional accuracy of the contacting point increases, so that the contact reliability increases.

In an embodiment according to the present invention, a position regulating recessed portion to be fitted with the position regulation contacting portion of the operating lever may be formed between the other end and the turning recessed portion at the upper side of the connection terminal.

According to such an embodiment, the operating lever is prevented from dropping in the horizontal direction without increasing the height dimension of the connection terminal, and furthermore, the height dimension of the entire connector by fitting the position regulation contacting portion of the operating lever into the position regulating recessed portion of the connection terminal.

In an embodiment of the present invention, a slip-out preventing projection for contacting the cam portion of the operating lever for position regulation may be formed between the slip-out preventing projection and the turning recessed portion of the connection terminal and at a position adjacent to the turning recessed portion.

According to such an embodiment, the operating lever is more unlikely to drop as the cam portion of the operating lever is position regulated in the horizontal direction by the slip-out preventing projection of the connection terminal.

In an embodiment of the present invention, a plurality of position regulating contacting portions juxtaposed at the operating lever may be coupled and integrated to be continuous on a same axis center.

According to the present embodiment, the strength can be increased while ensuring the operability of the operating lever.

In an embodiment of the present invention, a lock portion may be arranged at the slip-out preventing projection of the connection terminal and a lock receiving portion that locks with the lock portion may be formed at the position regulation contacting portion of the operating lever.

According to such an embodiment, the operating lever is more unlikely to drop and the operation feeling increases.

DETAILED DESCRIPTION

Hereinafter, embodiments of the present invention will be described with reference to the accompanying drawings FIGS. 1A to 13B.

As shown in FIGS. 1A to 3, a connector 10 according to a first embodiment is broadly configured by a base 11, a connection terminal 20, and an operating lever 30, and allows a flexible printed circuit board (FPC) 40 to be removably connected (FIGS. 4A to 5B).

Figure 6A:
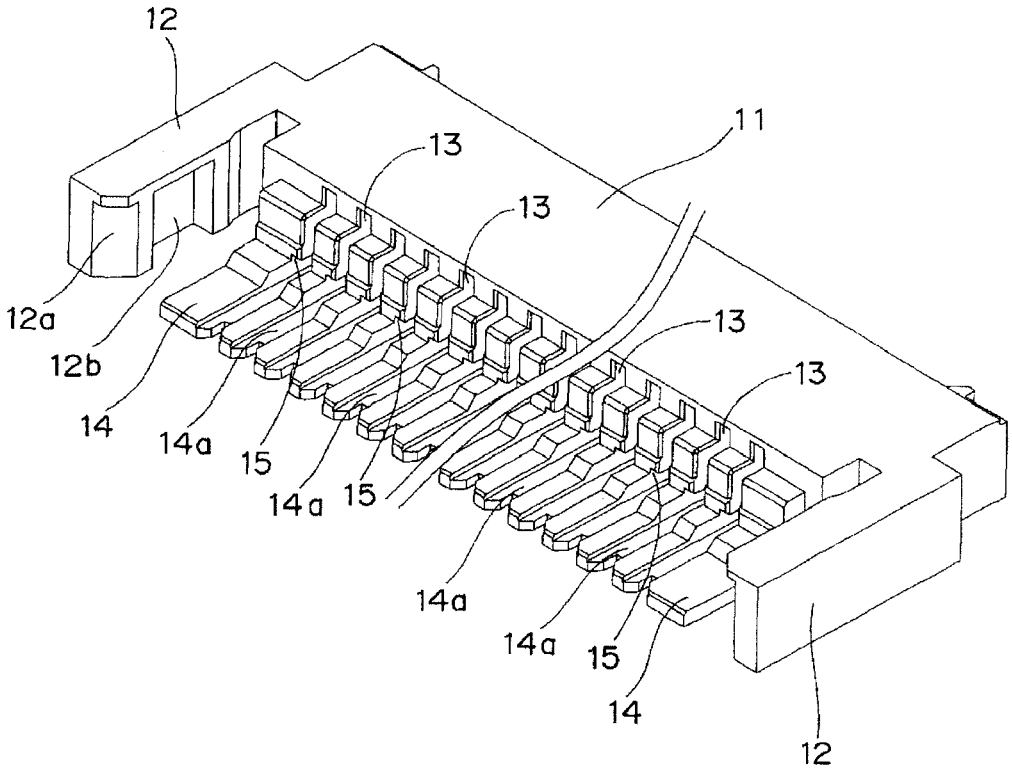
FIGS. 6A and 6B are partially broken perspective views of a base shown in FIG. 3.
Figure 6B:
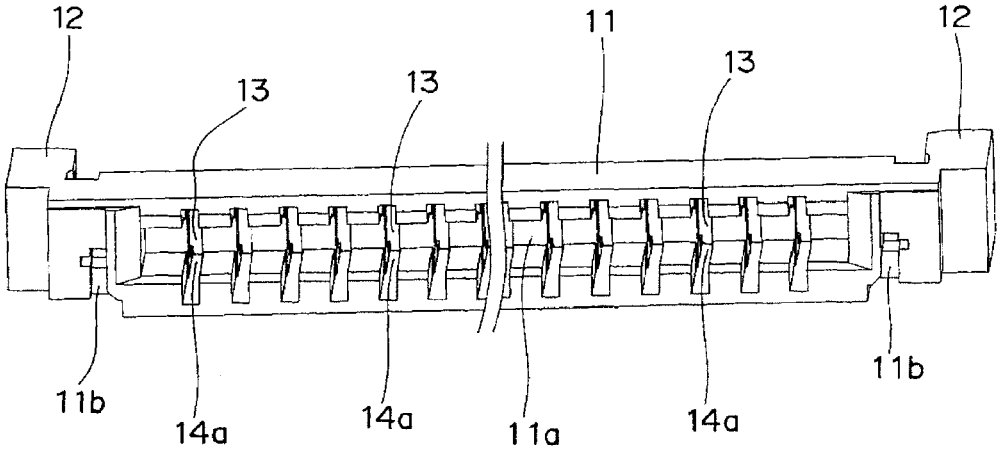

As shown in FIGS. 6A and 6B, the base 11 has elastic arms 12, 12 extending in parallel on the rear surface side from an edge on one side at both side end faces, and insertion holes 13 passing from the rear surface to the front surface are juxtaposed at a predetermined pitch.

As shown in FIG. 6A, a guide tapered surface 12*a* is formed at the distal end edge of the inward surface of the elastic arm 12, and a bearing portion 12*b* is formed on the far side thereof. The base 11 also has a guide plate 14 extending between the elastic arms 12, 12 from the lower edge of the rear surface, and a guide groove 14*a* to be inserted to each of the insertion hole 13 is juxtaposed at the upper surface of the guide plate 14. A slip-out preventing recessed portion 15 that communicates to the insertion hole 13 and that prevents slip-out of the connection terminal 20, to be hereinafter described, is formed at the basal portion on the lower side of the insertion hole 13.

Figure 1A:
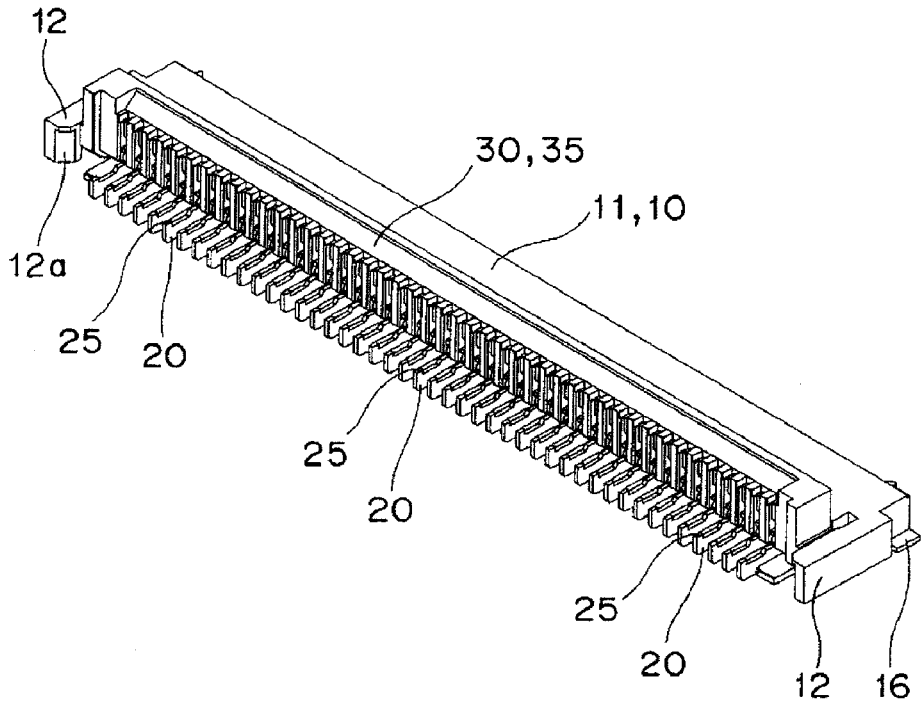
FIGS. 1A and 1B are perspective views of states before and after the operation showing a first embodiment of a connector according to the present invention.
Figure 1B:
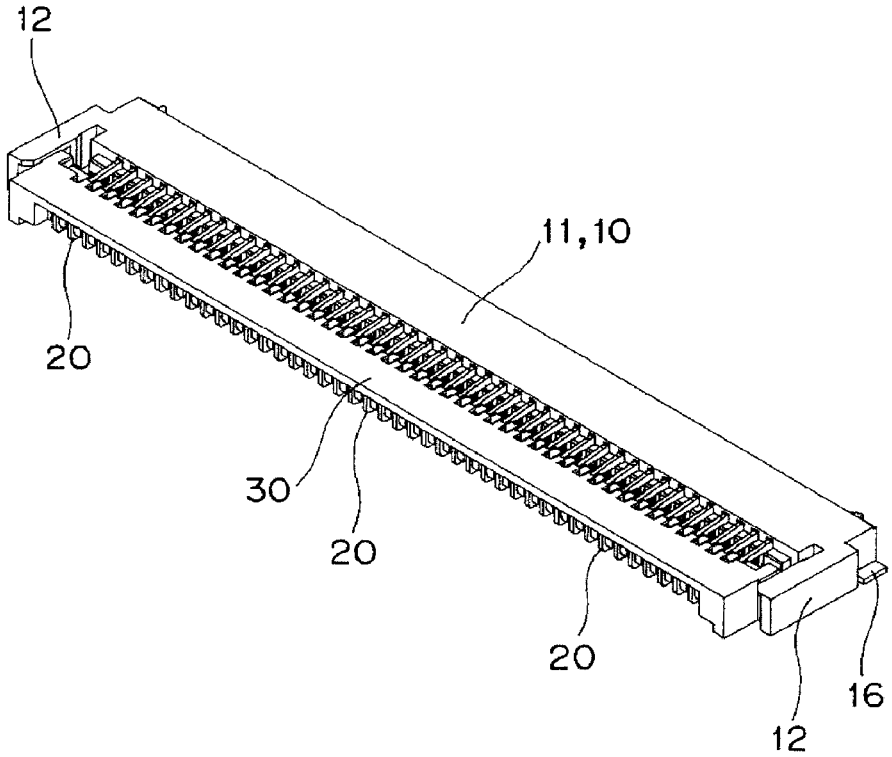
Figure 2A:
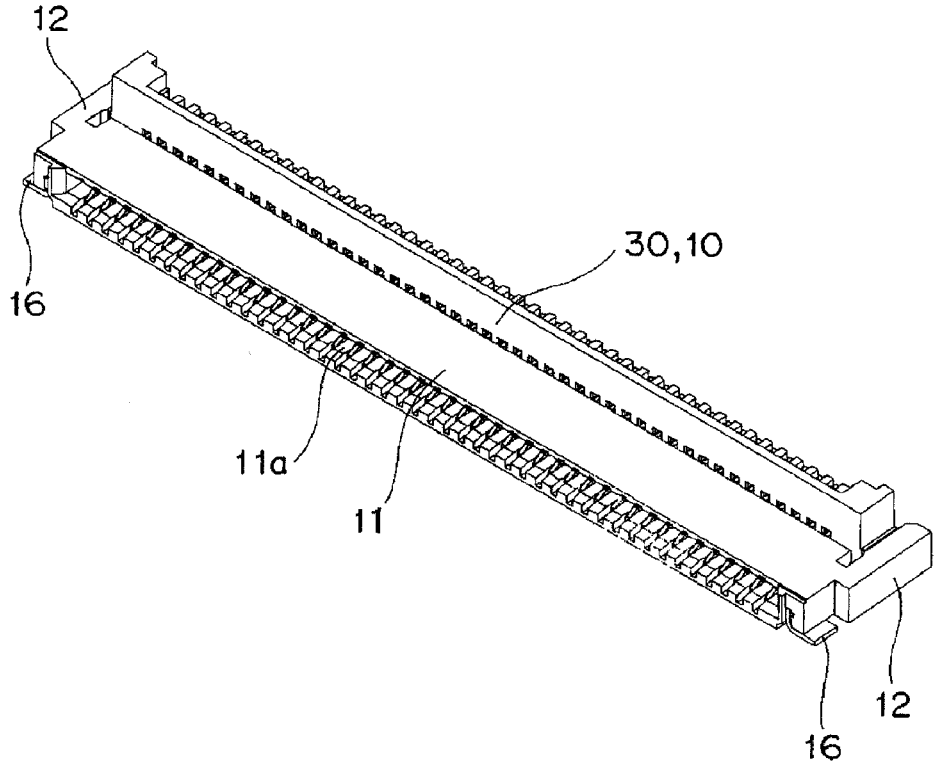
FIGS. 2A and 2B are perspective views, seen from different angles, of states before and after the operation of the connector shown in FIGS. 1A and 1B.
Figure 2B:
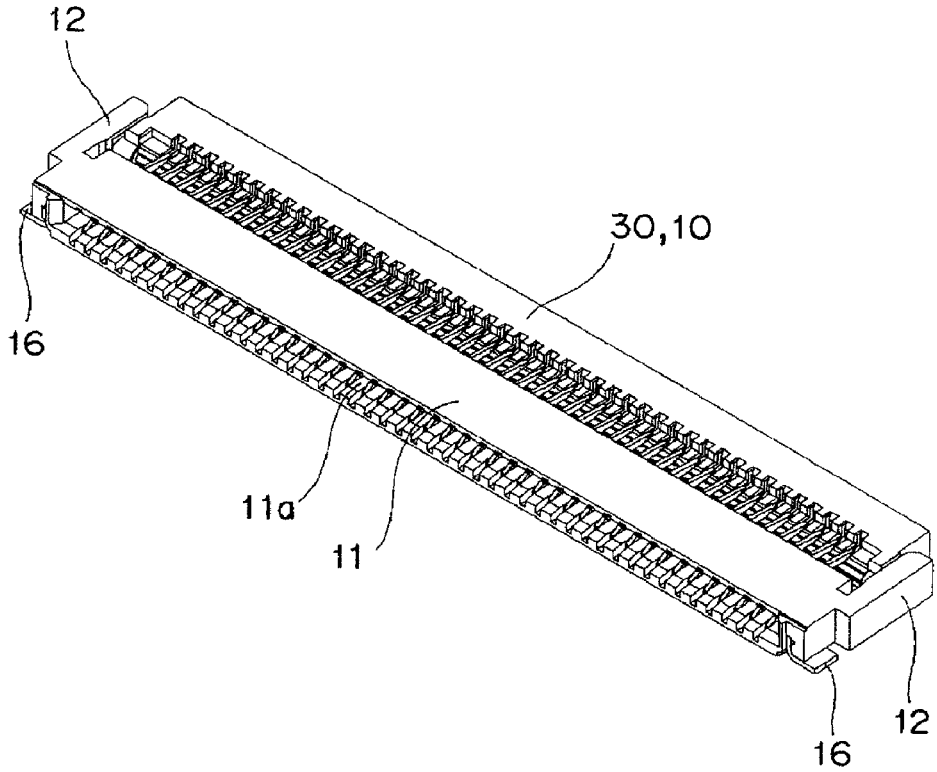
Figure 3:
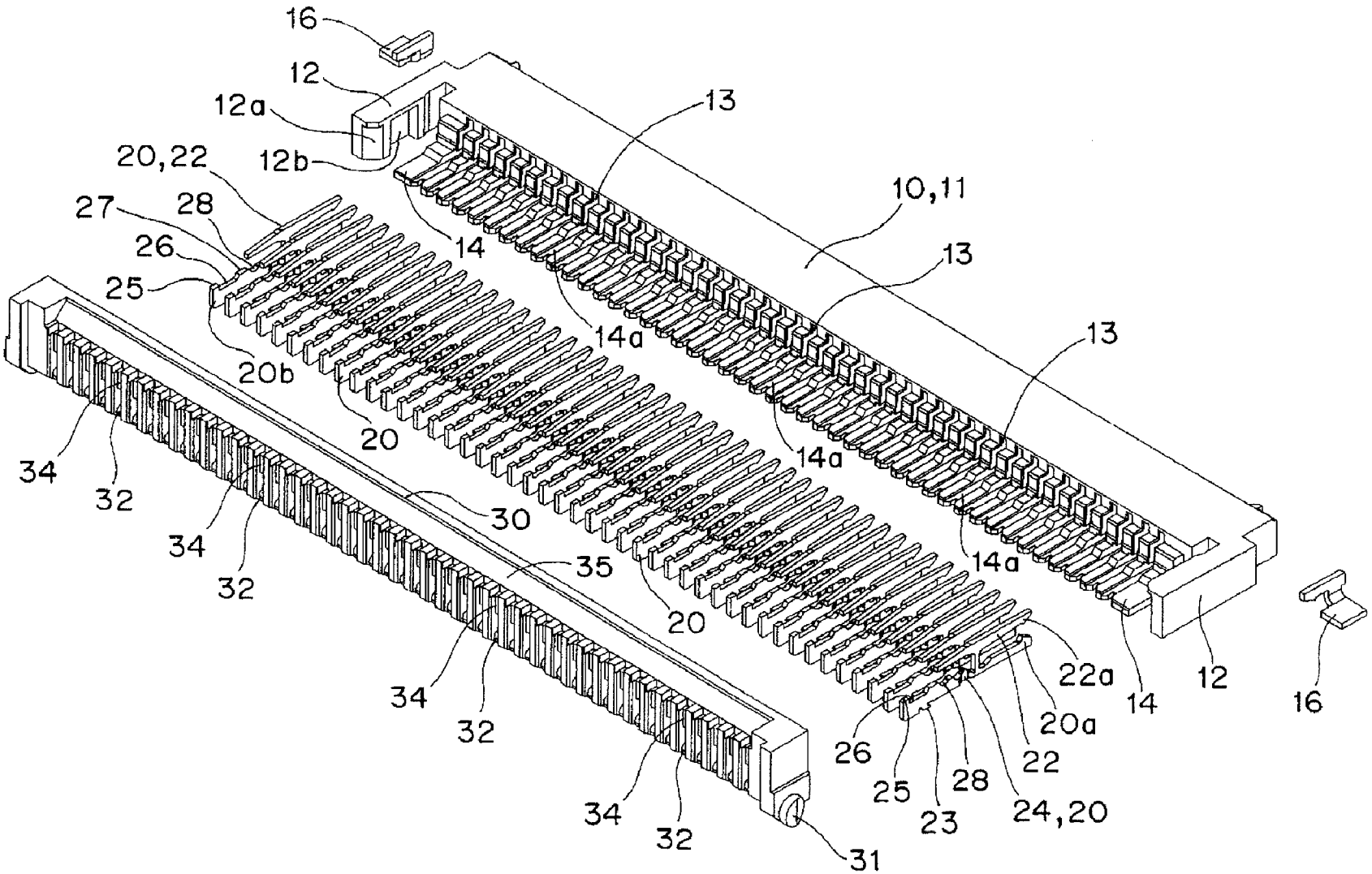
FIG. 3 is an exploded perspective view of the connector shown in FIGS. 1A and 1B.
Figure 4A:
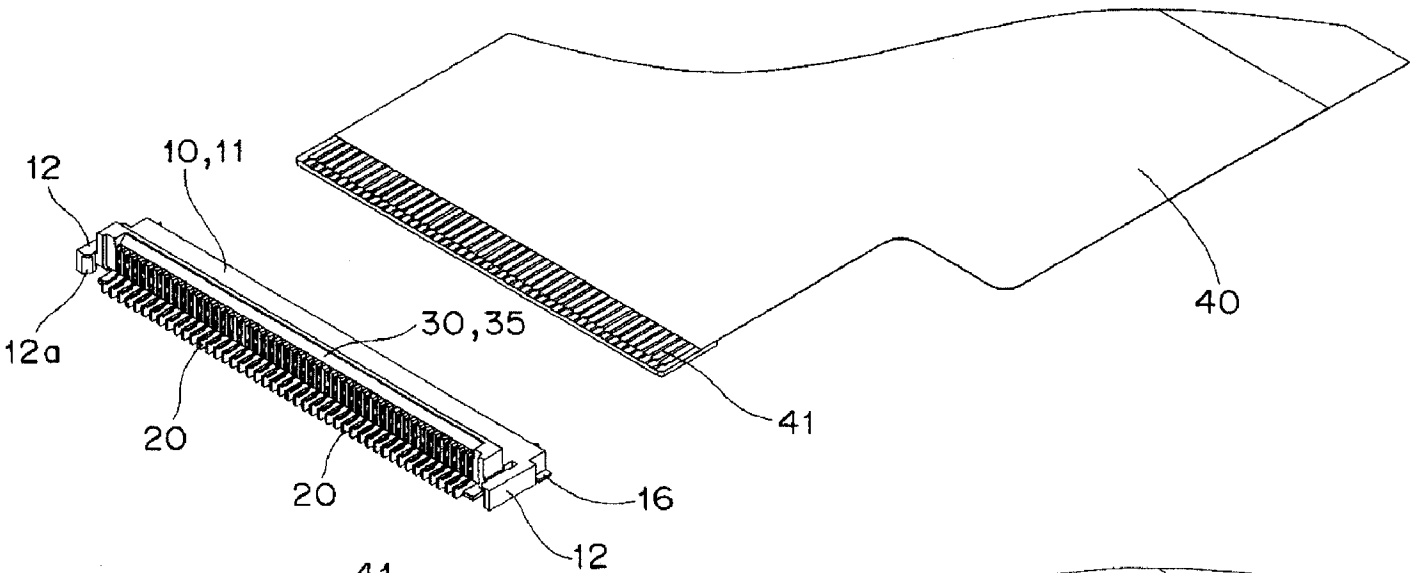
FIGS. 4A and 4B are partially broken perspective views of states before and after attachment of a flexible printed circuit board to the connector shown in FIGS. 1A and 1B.
Figure 4B:
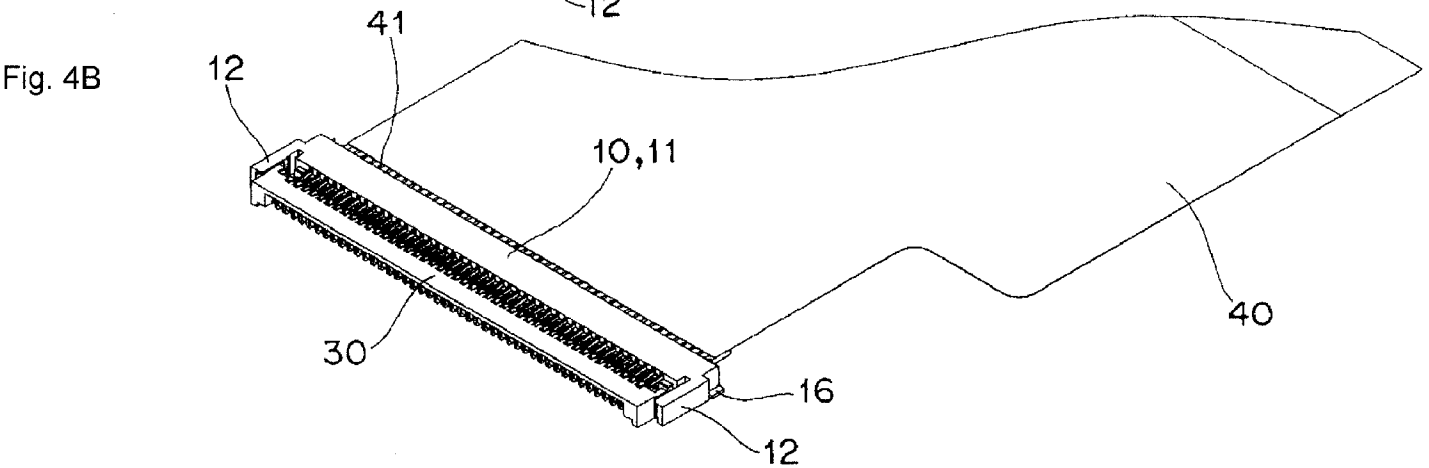
Figure 5A:
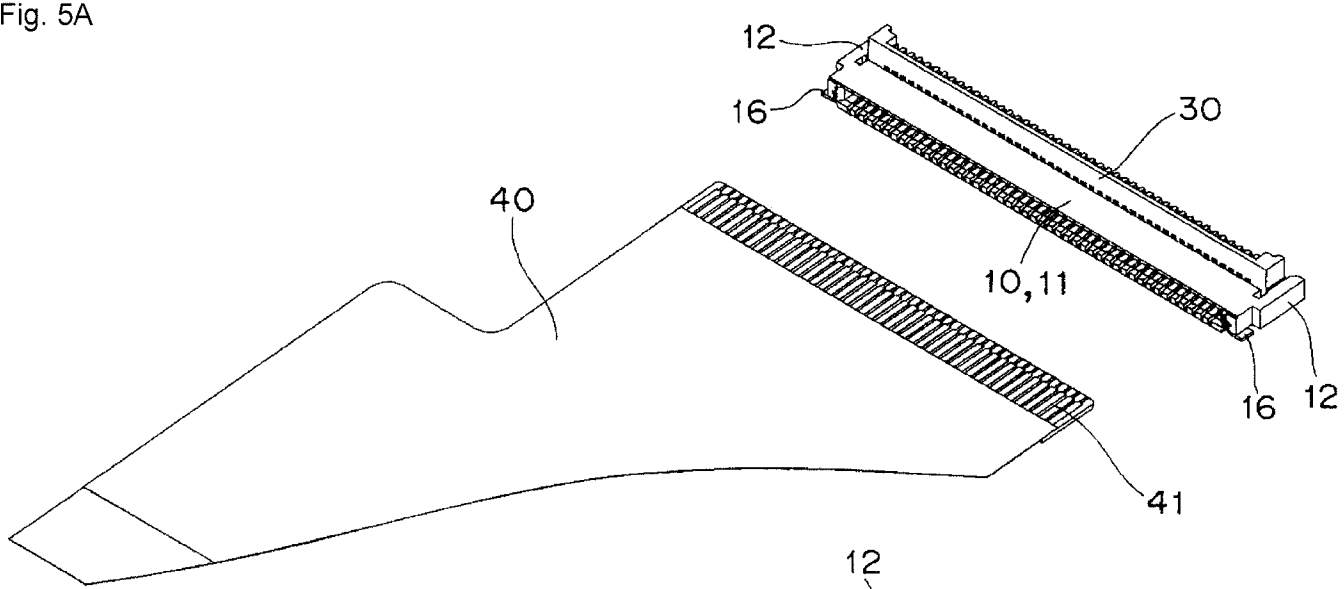
FIGS. 5A and 5B are partially broken perspective views, seen from different angles, of states before and after attachment of a flexible printed circuit board to the connector shown in FIGS. 1A and 1B.
Figure 5B:
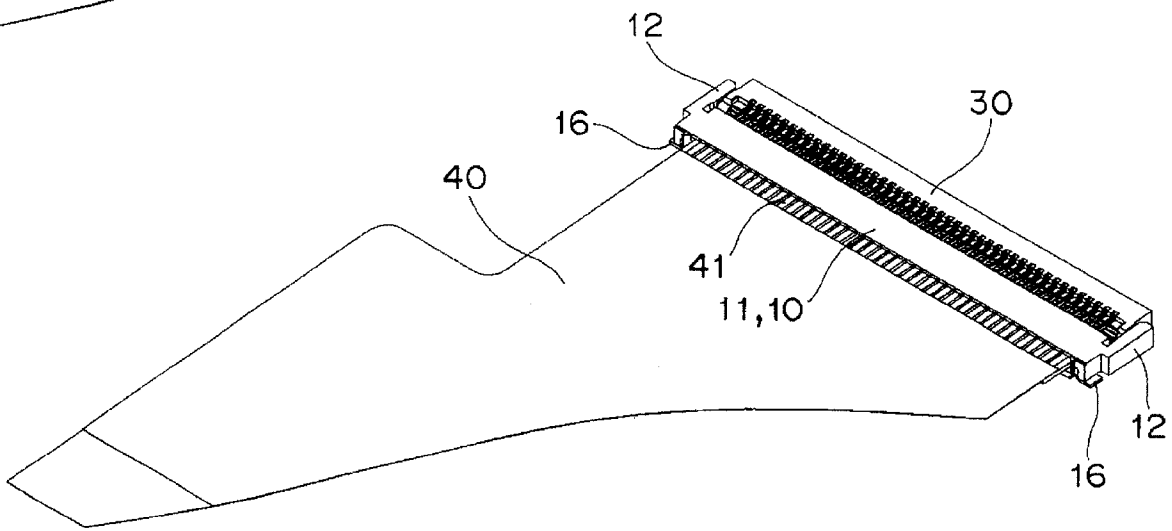

As shown in FIG. 6B, the base 11 includes an opening 11*a* for receiving a flexible printed circuit board 40, to be hereinafter described, at the front surface side. The base 11 press-fits and holds support fittings 16, 16 for preventing lift-up in time of mounting in press-fit grooves 11*b* formed at both side edges on the front surface side (FIGS. 2A, 2B and 3).

Figure 7A:
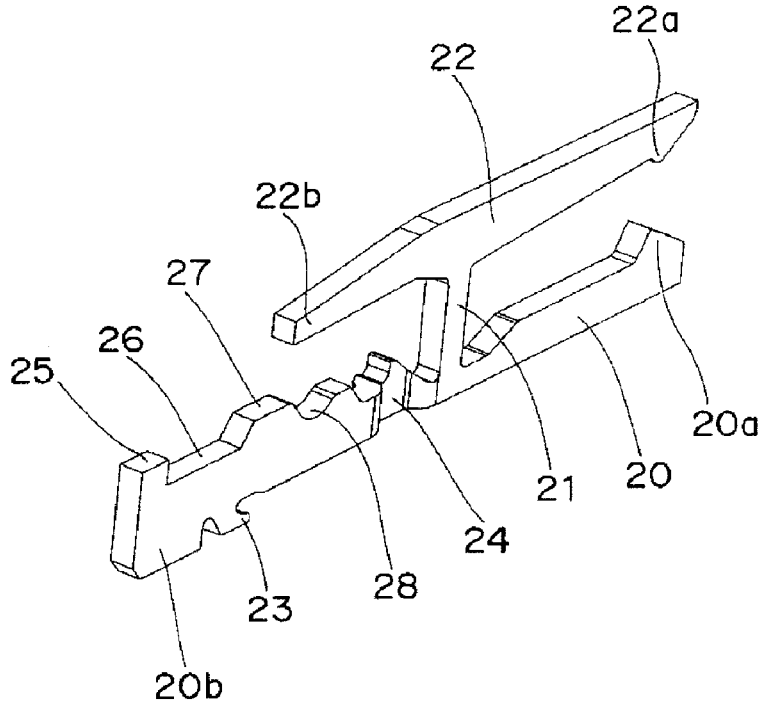
FIGS. 7A and 7B are a perspective view and a front view, respectively, of a connection terminal shown in FIG. 3.
Figure 7B:
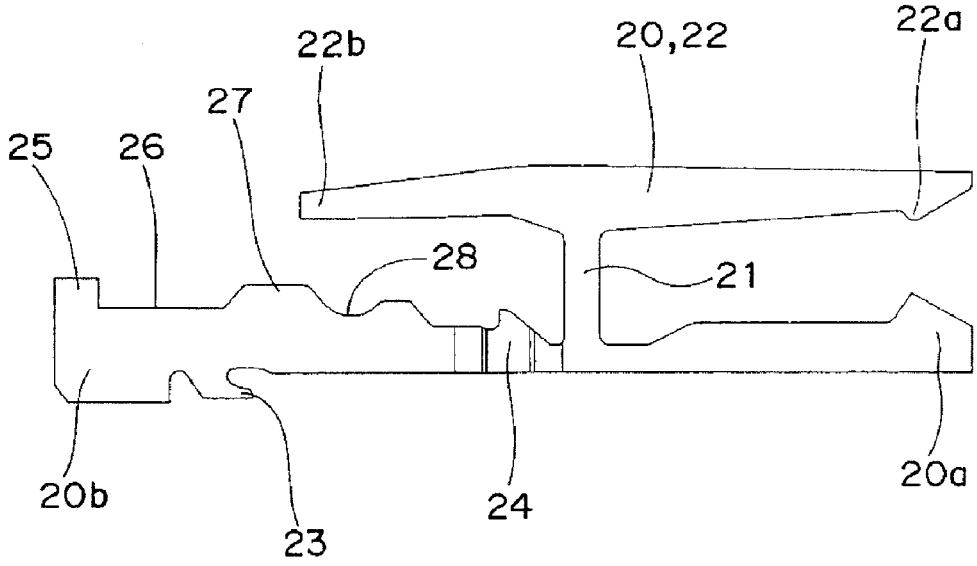

As shown in FIGS. 7A and 7B, the connection terminal 20 can insert a fixed contacting point 20*a* arranged at one end to the insertion hole 13 of the base 11, where a substantially T-shaped operating piece 22 including a supporting portion 21 is arranged in a projecting manner from an intermediate portion, and a locking nail portion 23 is formed at the lower edge on the other end 20*b*. One end of the operating piece 22 has a movable contacting point 22*a* projecting downward, and the other end acts an operation receiving portion 22*b*. The connection terminal 20 also has the basal portion of the supporting portion 21 projecting in the plate thickness direction to form a slip-out preventing nail portion 24. A slip-out projection 25, a position regulating portion 26, a slip-out preventing projection 27, and a turning recessed portion 28 are formed at the upper side positioned between the other end 20*b* and the slip-out preventing nail portion 24.

Figure 8A:
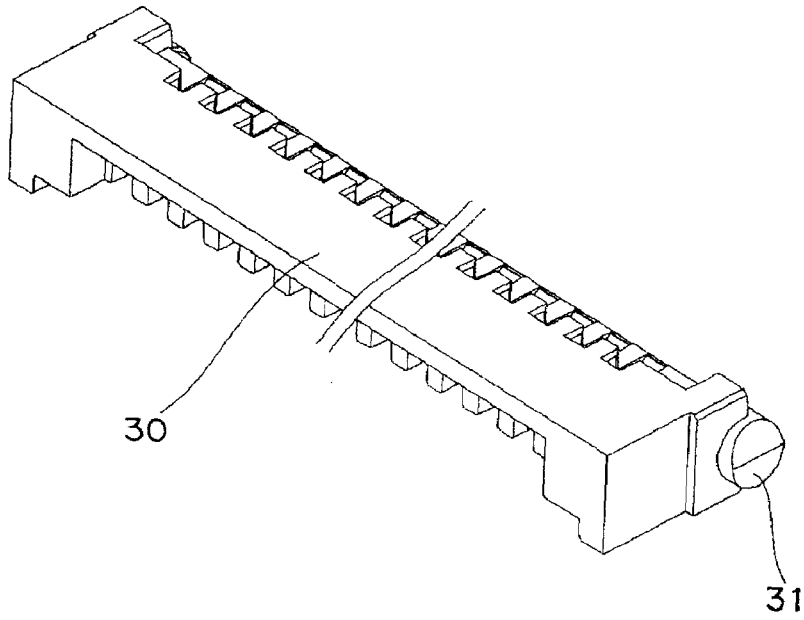
FIGS. 8A, 8B, and 8C are partially broken perspective views of the operating lever shown in FIG. 3.
Figure 8B:
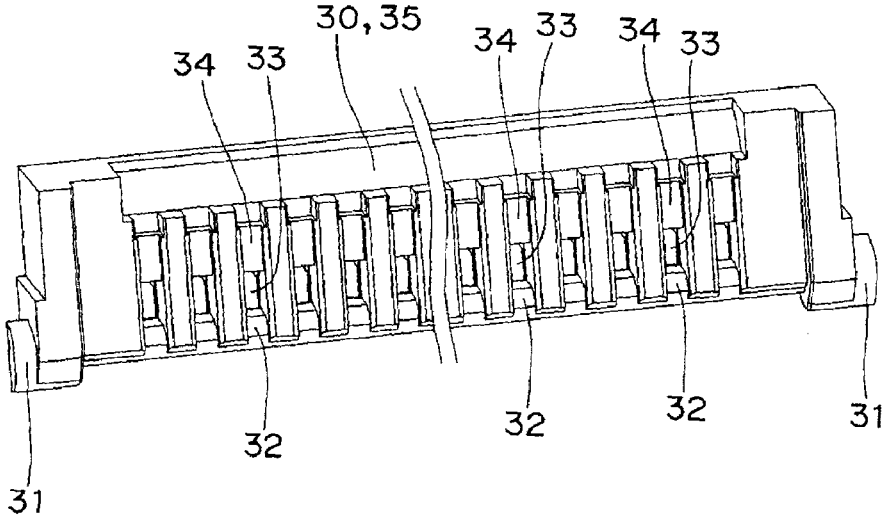
Figure 8C:
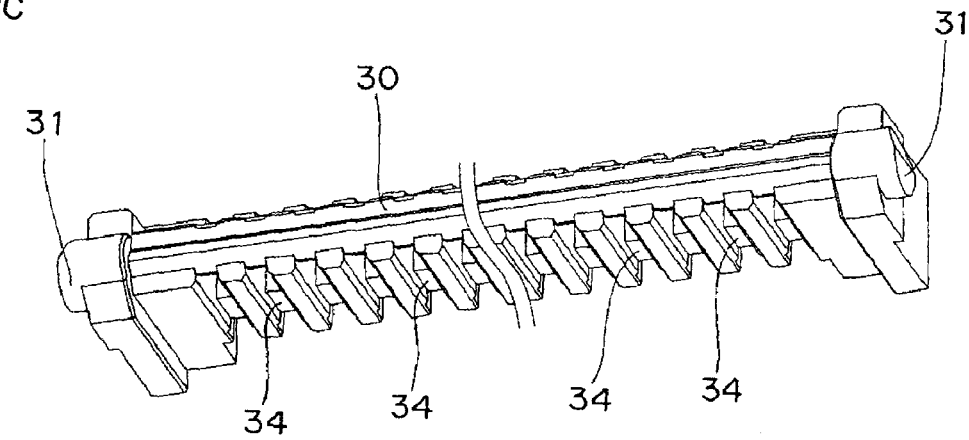

As shown in FIGS. 8A to 8C, the operating lever 30 has turning shaft portions 31, 31 arranged in a projecting manner on the same axis center at both side end faces. The operating lever 30 has cam portions 32 for operating the operation receiving portion 22*b* of the connection terminal 20 juxtaposed at a predetermined pitch at an edge on one side, and through-holes 33 for inserting the operating piece 22 juxtaposed at positions corresponding to the cam portions 32. Furthermore, the operating lever 30 has position regulation contacting portions 34 that contact the position regulating portion 26 of the connection terminal 20 formed at positions adjacent to the through-holes 33. Each of the position regulation contacting portion 34 includes a lower end face that contacts the position regulating portion 26 of the connection terminal 20 immediately after or at the same time as the completion of the turning operation of the operating lever 30, and prevents the operating lever 30 from dropping due to excessive rotation. The position regulation contacting portions 34 are coupled so as to be continuous on the same axis center, and thus the operability is ensured and the strength is maintained. Moreover, the operating lever 30 has an operation tapered surface 35 formed and cut out at an edge on the other side, and thus the unlocking operation by a finger and the like is easily carried out even if the operating lever 30 becomes small.

As shown in FIGS. 4A to 5B, the FPC 40 connected to the connector 10 of the present embodiment has a joint 41 print wired at the tip portion.

A method for assembling the connector 10 including the components described above will now be described.

First, one end 20*a* of the connection terminal 20 is inserted to the insertion hole 13 along the guide groove 14*a* of the guide plate 14 from the rear surface side of the base 11. The slip-out preventing nail portion 24 arranged on the connection terminal 20 then locks to a roof surface of the slip-out preventing recessed portion 15 of the base 11, and the locking nail portion 23 locks to the edge of the base 11 to be positioned.

Figure 9A:
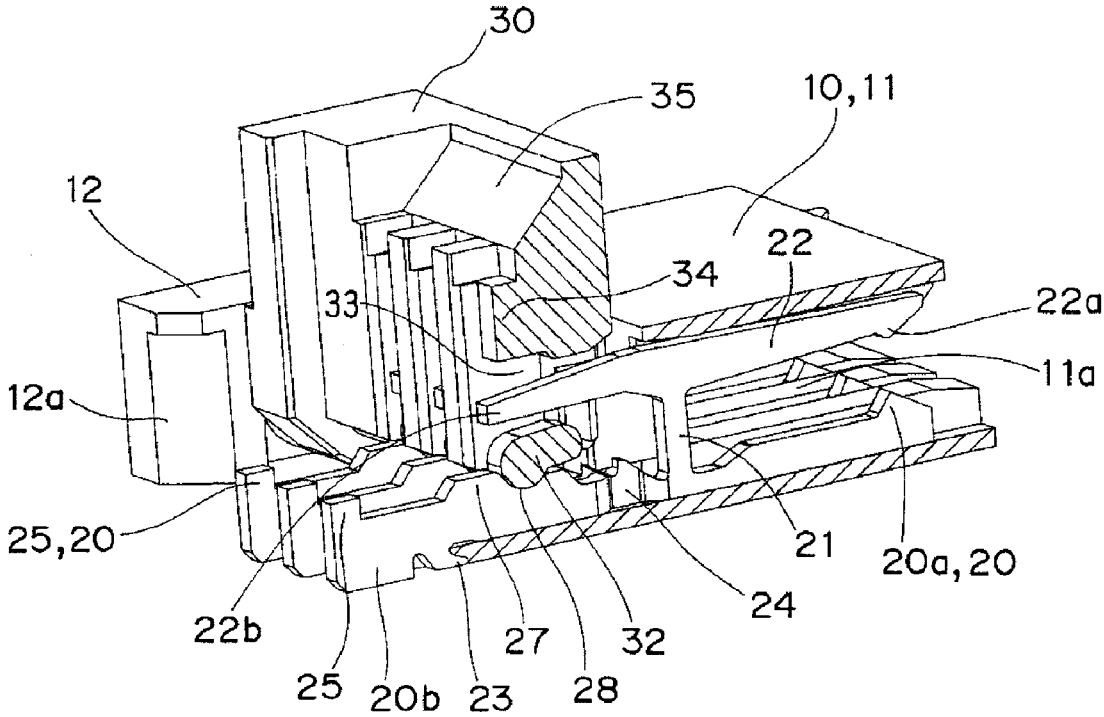
FIGS. 9A and 9B are a partially broken perspective view and a front cross-sectional view, respectively, for describing a method for operating the connector according to the first embodiment.
Figure 9B:
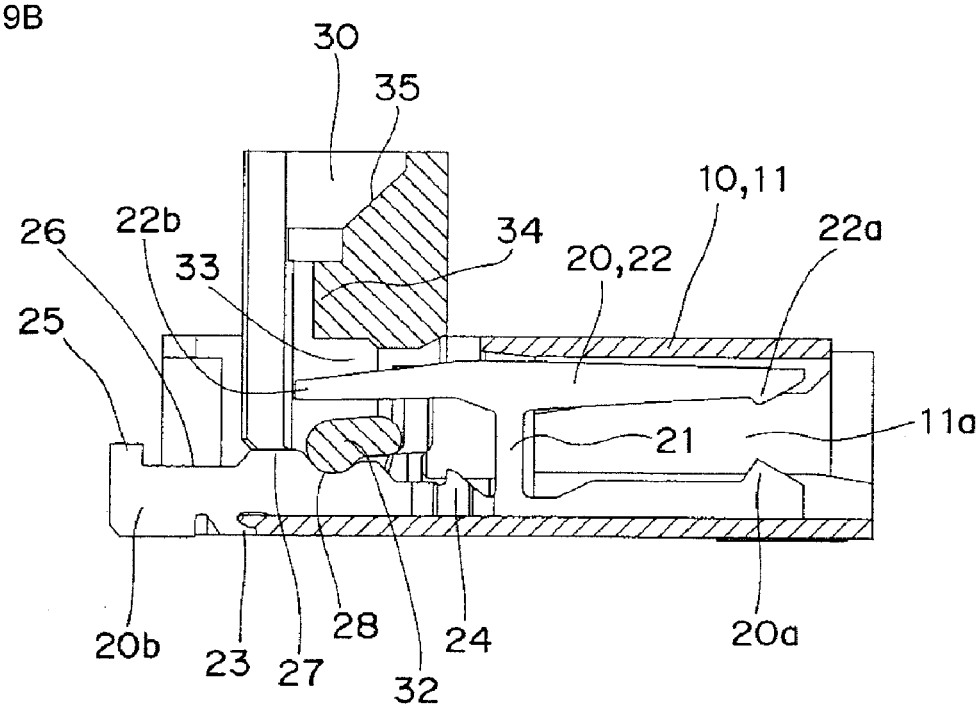

The operation receiving portion 22*b* of the connection terminal 20 is then inserted to the through-hole 33 of the operating lever 30, the operating lever 30 is sled along the upper side of the connection terminal 20, and the operation receiving portion 22*b* is pushed up and pushed in an elastically deformed state with the cam portion 32. The cam portion 32 then fits into the turning recessed portion 28 of the connection terminal 20, and the turning shaft portion 31 passes through the guide tapered surface 12*a* of the base 11 to fit into the bearing portion 12*b*, whereby the operating lever 30 is supported in a turnable manner (FIG. 9A and 9B).

According to the present embodiment, even when attempting to excessively rotate the operating lever 30 to the lock side, the position regulation contacting portion 34 of the operating lever 30 contacts the position regulating portion 26 of the connection terminal 20 so as to be position regulated, as shown in FIGS. 10A to 11B. Thus, dropping of the operating lever 30 due to excessive rotation that occurs when the operating lever 30 is turning operated can be prevented.

Figure 11A:
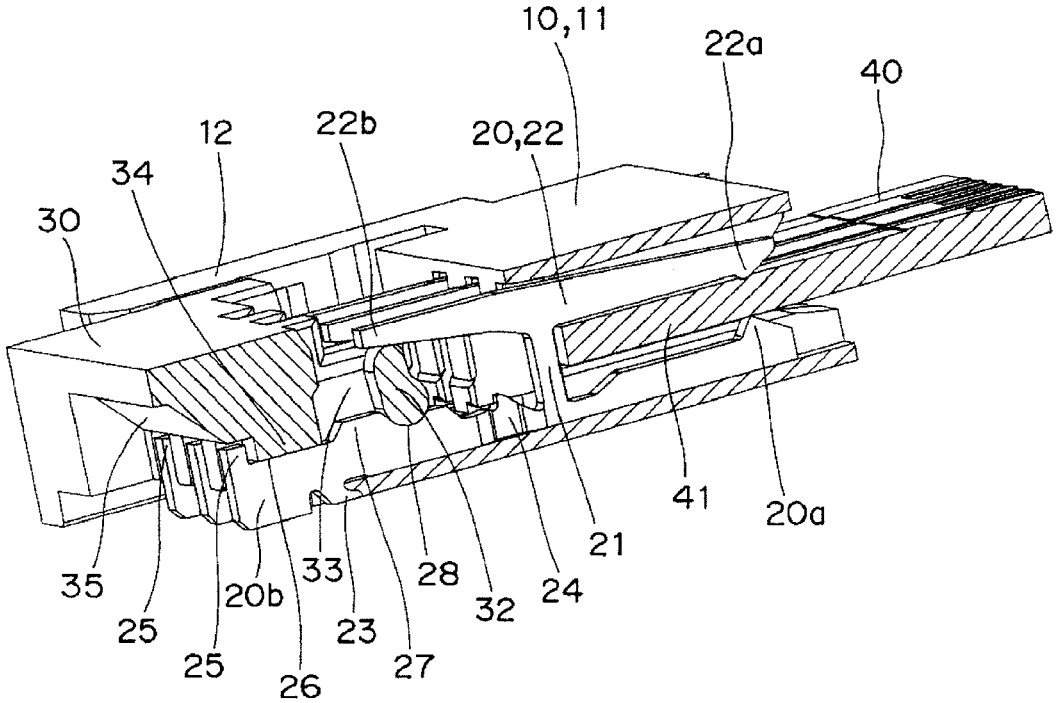
FIGS. 11A and 11B are a partially broken perspective view and a front cross-sectional view, respectively, for describing the method for operating the connector following FIGS. 10A and 10B.
Figure 11B:
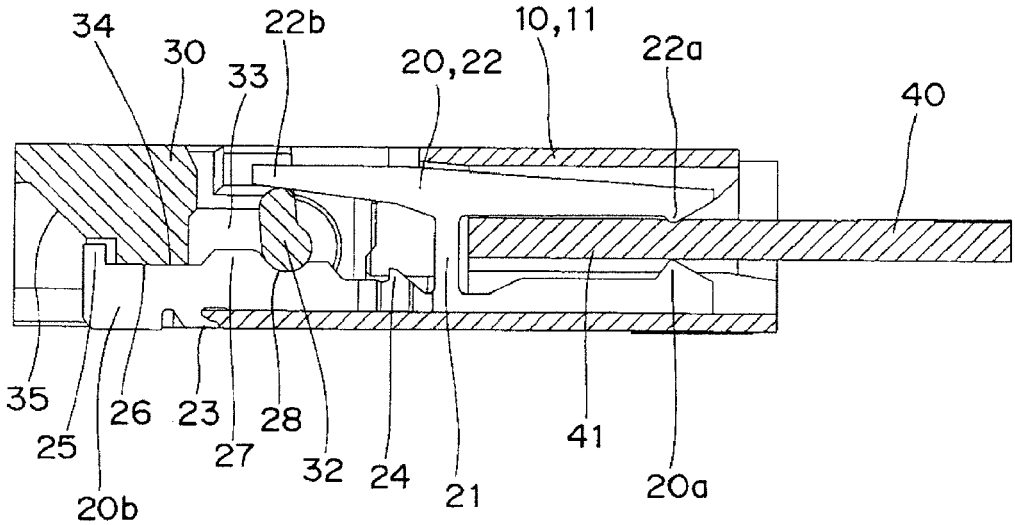

As shown in FIGS. 11A and 11B, in the present embodiment, the operating lever 30 does not drop to the side since the position regulation contacting portion 34 locks to the slip-out preventing projection 25 even if the horizontal component force of the turning operation force is applied on the operating lever 30.

Moreover, since the slip-out preventing projection 27 is arranged immediately after the turning recessed portion 28, the cam portion 32 of the operating lever 30 contacts the slip-out preventing projection 27 and thus the operating lever is more unlikely to drop.

A method for connecting the flexible printed circuit board 40 to the connector 10 will now be described based on FIGS. 9A to 12B.

Figure 10A:
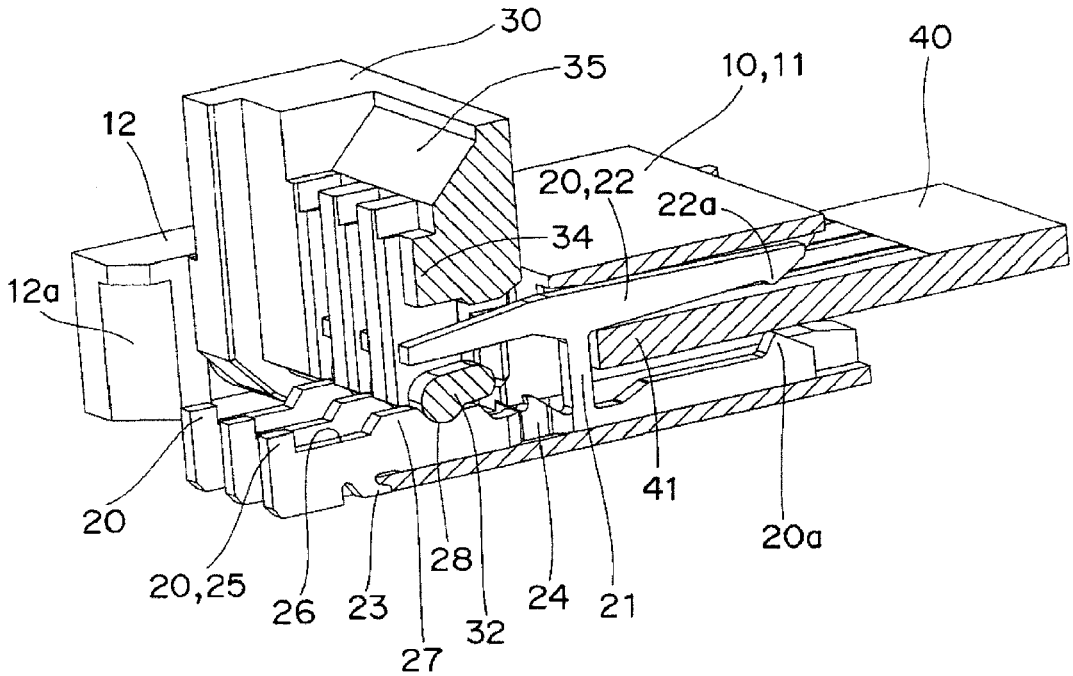
FIGS. 10A and 10B are a partially broken perspective view and a front cross-sectional view, respectively, for describing the method for operating the connector following FIGS. 9A and 9B.
Figure 10B:
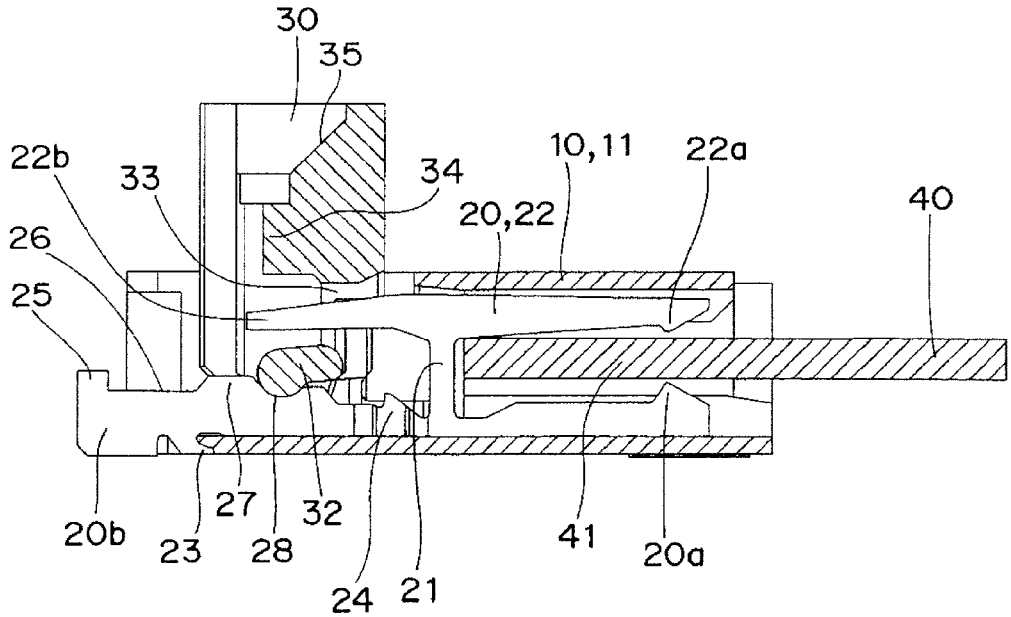

First, as shown in FIGS. 9A and 9B, the joint 41 of the flexible printed circuit board 40 is inserted to the opening 11*a* of the base 11 until hitting the inner side surface of the base (FIGS. 10A and 10B). The operating lever 30 is then turned with the axis center of the turning shaft portion 31 as the center and then pushed down, so that the cam portion 32 pushes up the operation receiving portion 22*b* of the connection terminal 20, as shown in FIGS. 11A and 11B. Thus, the substantially T-shaped operating piece 22 tilts with the supporting portion 21 as the supporting point, whereby the movable contacting point 22*a* pressure contacts and conducts to the joint 41 of the flexible printed circuit board 40. The dropping of the operating lever 30 due to excessive rotation is prevented as the position regulation contacting portion 34 contacts the position regulating portion 26 of the connection terminal 20 even if the operating lever 30 is further turned.

In the present embodiment, the position regulation contacting portion 34 of the operating lever 30 engages the slip-out preventing projection 25 of the connection terminal 20 at the completion of the turning operation of the operating lever 30. Thus, the operating lever 30 is reliably prevented from dropping even if horizontal component force of the rotational operating force acts on the operating lever 30.

Furthermore, since the cross-section of the cam portion 32 has a substantially elliptical shape, a reliable operation feeling can be obtained when turned by a predetermined angle as the rotation moment suddenly changes.

When detaching the flexible printed circuit board 40 from the connector 10, the operating lever 30 is turned in the direction opposite to the above to thereby reverse the cam portion 32 and release the bending moment on the operation receiving portion 22*b* of the connection terminal 20, and the flexible printed circuit board 40 is pulled out from the base 11 after the connection state of the movable contacting point 22*a* with respect to the joint 41 of the flexible printed circuit board 40 is released.

Figure 12A:
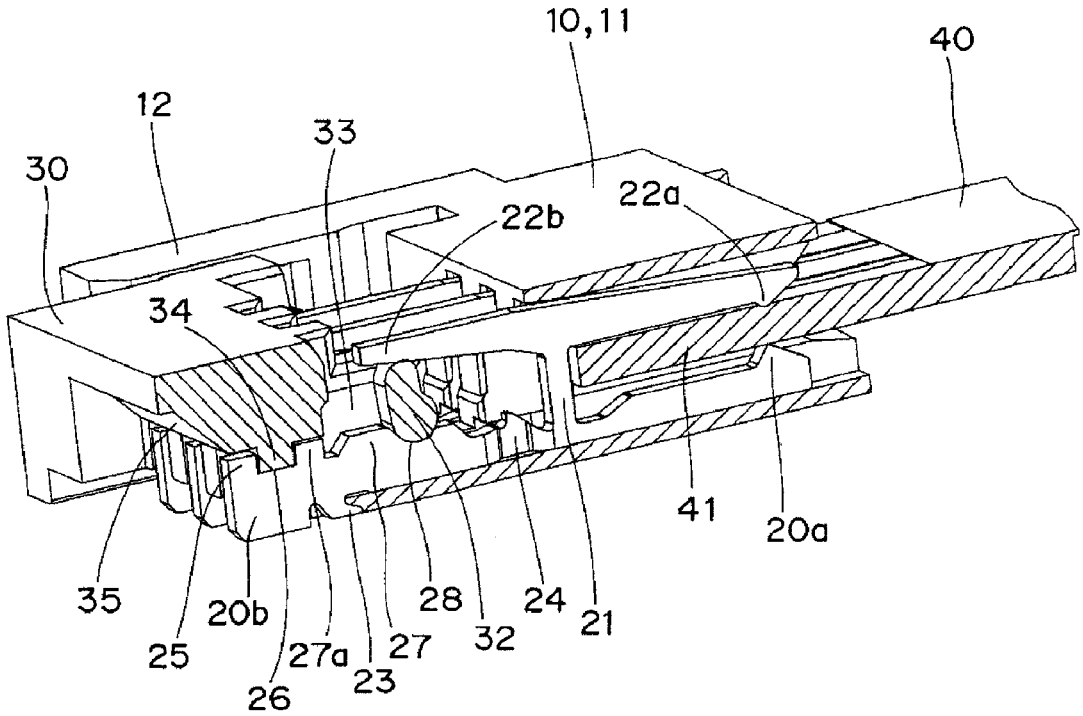
FIGS. 12A and 12B are a partially broken perspective view and a front cross-sectional view, respectively, for describing a connector according to a second embodiment.
Figure 12B:
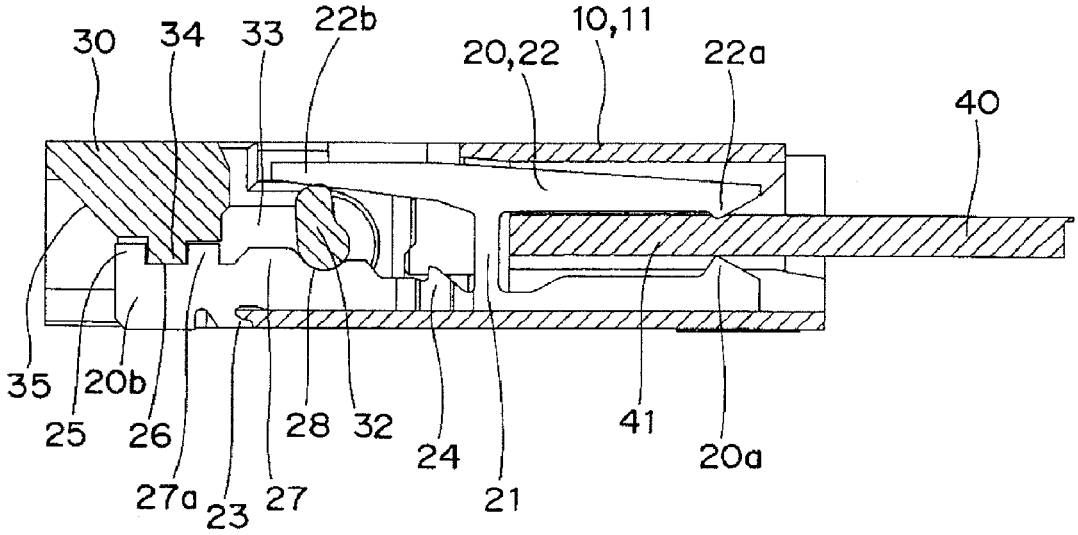

As shown in FIGS. 12A and 12B, a second embodiment is substantially the same as the first embodiment, and thus like reference numerals are denoted for like portions, and the description thereof will not be given.

The present embodiment differs from the first embodiment in that a second slip-out preventing projection 27*a* is arranged at a position adjacent to the slip-out preventing projection 27. The position regulation contacting portion 34 of the operating lever 30 is then position regulated in the horizontal direction by the slip-out preventing projection 27 and the second slip-out preventing projection 27*a*, and the rattling of the operating lever 30 is more reliably regulated.

Figure 13A:
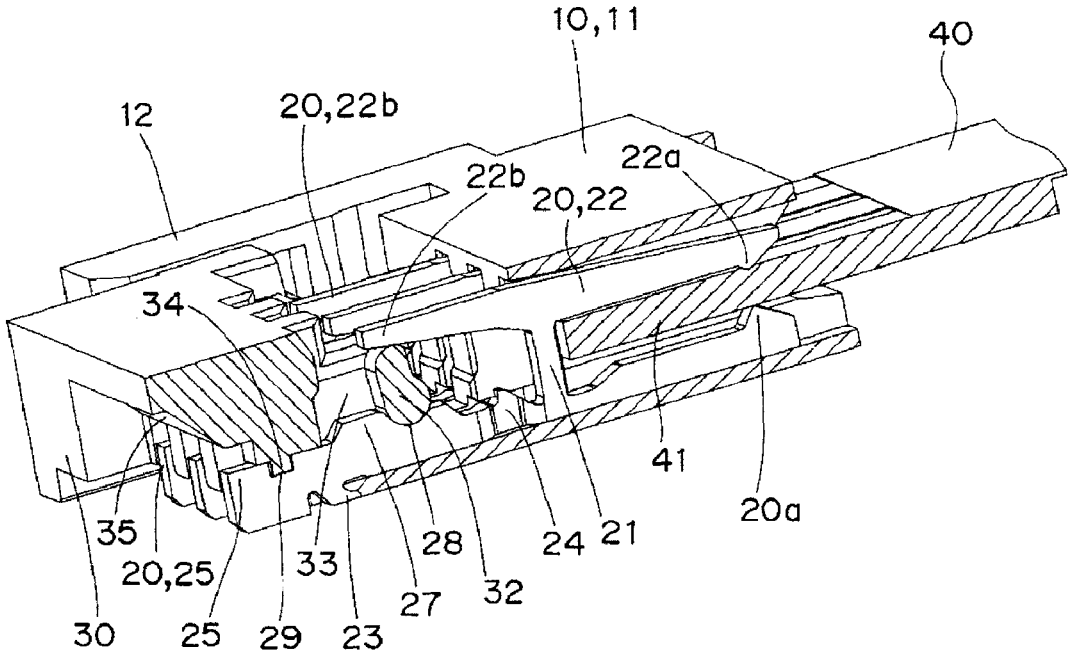
FIGS. 13A and 13B are a partially broken perspective view and a front cross-sectional view, respectively, for describing a connector according to a third embodiment.
Figure 13B:
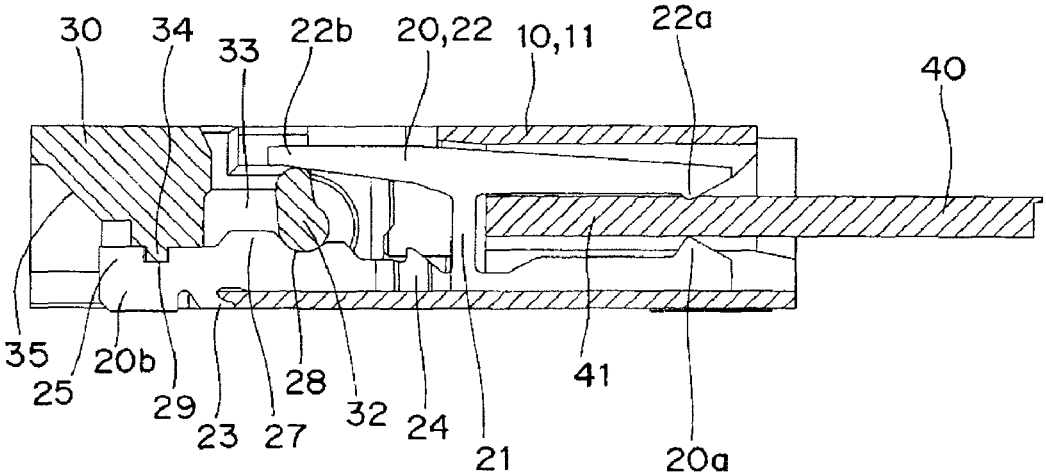
Figure 14A:
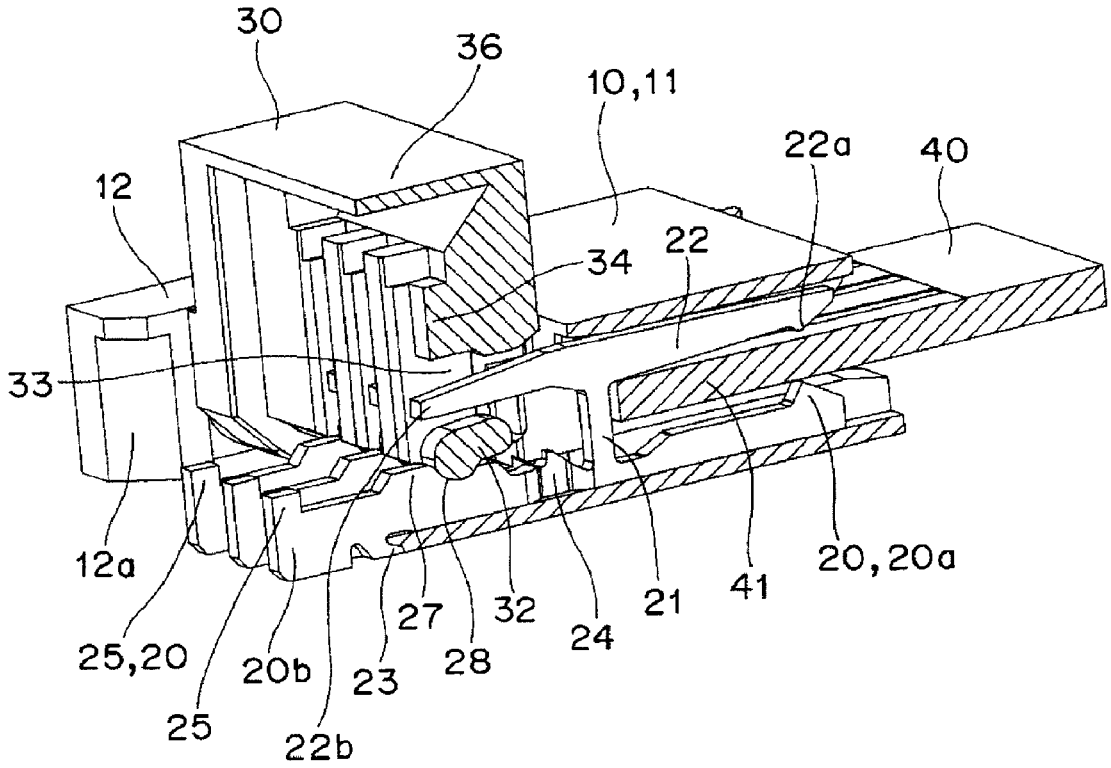
FIGS. 14A and 14B are a partially broken perspective view and a front cross-sectional view, respectively, for describing a connector according to a fourth embodiment.
Figure 14B:
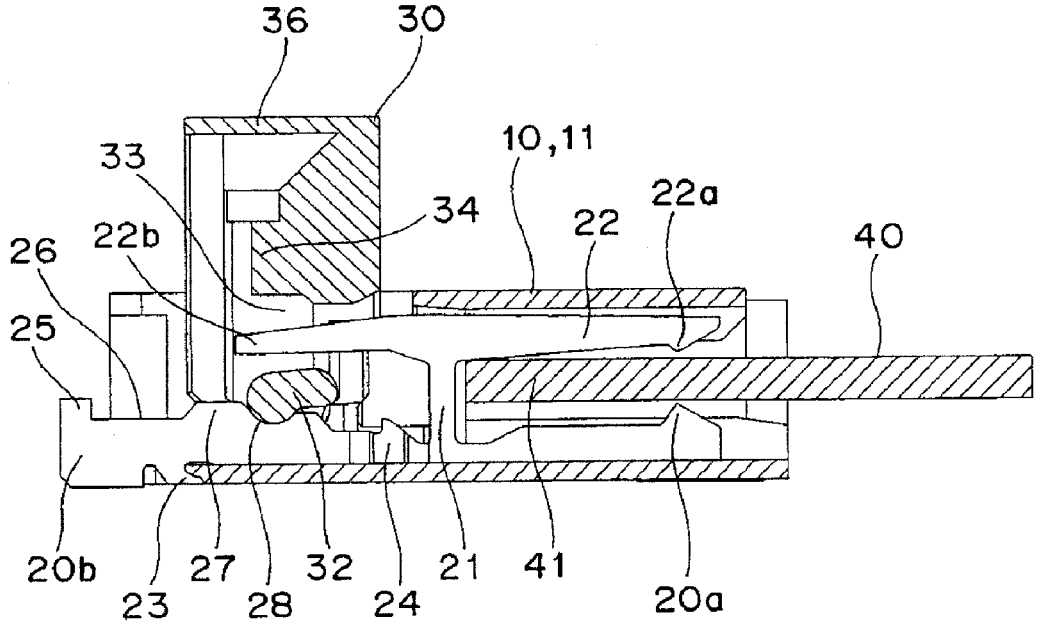
Figure 15A:
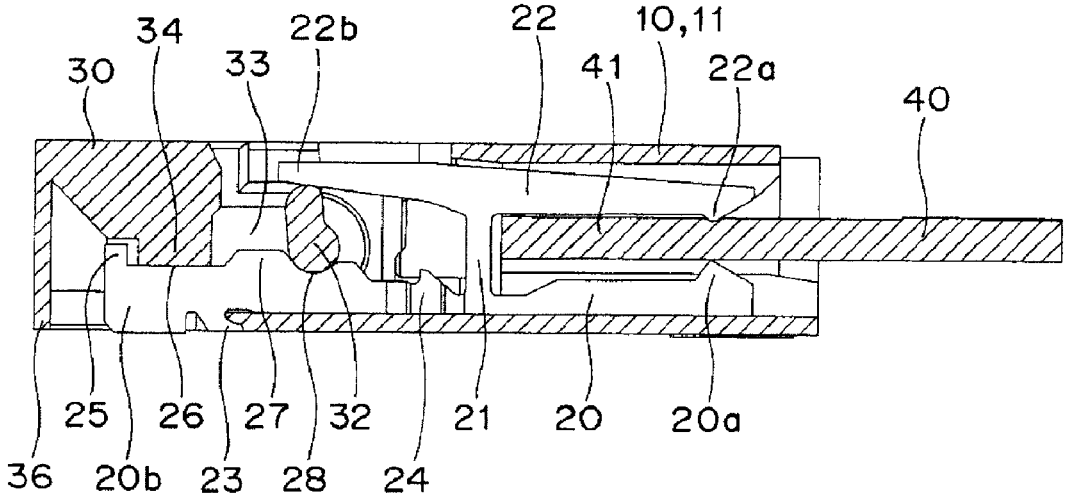
FIGS. 15A and 15B are a front cross-sectional view and a partially broken perspective view seen from below showing a state after the turning operation of the connector according to the fourth embodiment.
Figure 15B:
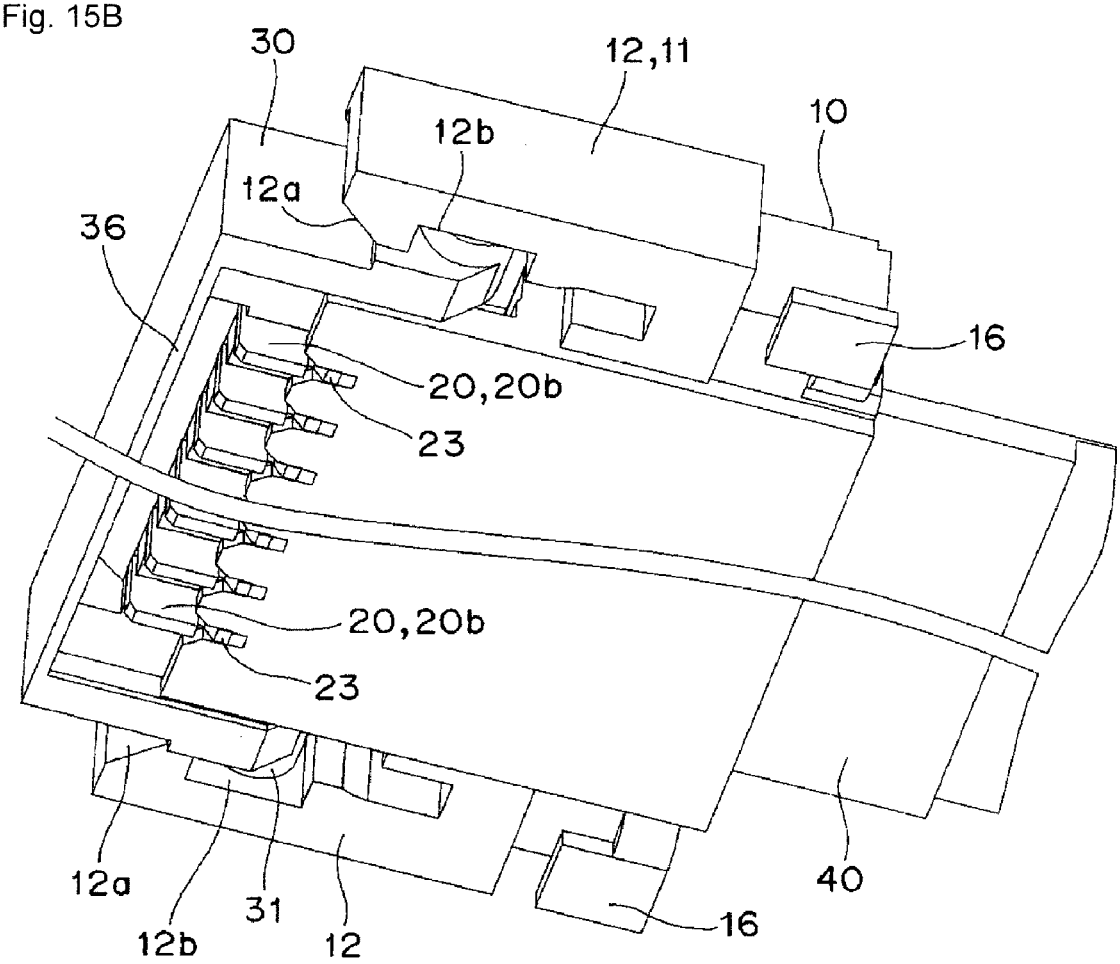

As shown in FIGS. 13A and 13B, a third embodiment is substantially the same as the first embodiment, and differs in that a position regulating recessed portion 29 is arranged at the upper side of the connection terminal 20. Like reference numerals are denoted for like portions, and the description thereof will not be given.

According to the present embodiment, the lower surface of the position regulation contacting portion 34 of the operating lever 30 is contacted to the bottom surface of the position regulating recessed portion 29 to prevent the operating lever 30 from dropping due to excessive rotation.

The interference dimension with respect to the position regulation contacting portion 34 of the operating lever 30 can be set large. Thus, the dropping of the operating lever 30 due to the horizontal component force of the turning operation force is prevented as the position regulation contacting portion 34 locks with the inner side surface of the position regulating recessed portion 29.

Furthermore, the height dimension of the connection terminal 20, and furthermore, the height dimension of the entire connector 10 can be suppressed, and a thin connector 10 can be obtained.

As shown in FIGS. 14A to 15B, a fourth embodiment is substantially the same a the first embodiment, and differs in that a position regulating wall portion 36 is arranged in a projecting manner at the outer peripheral edge of the lower surface of the operating lever 30. Others are the same, and thus like reference numerals are denoted for like portions, and the description thereof will not be given.

According to the present embodiment, the other end 20*b* of the connection terminal 20 is covered by the position regulating wall portion 36, whereby dust resistance is enhanced, and short-circuit between the terminals due to foreign substance and the like can be prevented.

In the embodiments described above, a case of contacting the position regulation contacting portion 34 of the operating lever 30 to the upper side of the connection terminal 20 for position regulation has been described, but it is not necessarily limited thereto, and the operating lever 30 is prevented from dropping due to excessive rotation by contacting the position regulation contacting portion arranged on the operating lever 30 to the upper surface of the guide plate 14 of the base 11.

Furthermore, a locking portion is arranged on the position regulation contacting portion 34 of the operating lever 30, and a locking receiving portion that locks with the locking portion is arranged at the slip-out preventing projection 25 of the connection terminal 20, so that the operating lever is further prevented from dropping and the operation feeling is enhanced.

The slip-out preventing projection of the connection terminal is not limited to being arranged at the other end of the upper side, and merely needs to be formed between the back end and the turning recessed portion, and in particular, the slip-out preventing projection is preferably arranged near the portion to be soldered to the wiring substrate.

The connector 10 according to the present invention is not limited to the connector described above, and it should be recognized that it may be applied to other connectors.

What is claimed is:

1. A connector comprising:

a base having an opening to be inserted with a tip portion of a flexible printed circuit board at a front surface, and having a plurality of insertion holes passing from the front surface to a rear surface juxtaposed at a predetermined pitch;

a connection terminal arranged in a projecting manner with a substantially T-shaped operating piece having at one end a movable contacting point that comes into pressure contact with joints juxtaposed at the tip portion of the flexible printed circuit board, the connection terminal having one end that becomes a fixed contacting point inserted to the insertion hole from the rear surface side; and an operating lever in which a cam portion is fitted into a turning recessed portion arranged at an upper side of the connection terminal to act as a turning supporting point, the cam portion driving an operation receiving portion positioned at the other end of the operating piece;

wherein a position regulation contacting portion arranged at a lower surface of the operating lever locks to a slip-out preventing projection arranged in a projecting manner at an upper side of the connection terminal to prevent slip-out when the operating lever is turned and a locking operation is completed.

2. The connector according to claim 1, wherein a position regulating recessed portion to be fitted with the position regulation contacting portion of the operating lever is formed between the other end and the turning recessed portion at the upper side of the connection terminal.

3. The connector according to claim 1, wherein a slip-out preventing projection for contacting the cam portion of the operating lever for position regulation is formed between the slip-out preventing projection and the turning recessed portion of the connection terminal and at a position adjacent to the turning recessed portion.

4. The connector according to claim 1, wherein a plurality of position regulating contacting portions juxtaposed at the operating lever are coupled and integrated to be continuous on a same axis center.

5. The connector according to claim 1, wherein a lock portion is arranged at the slip-out preventing projection of the connection terminal and a lock receiving portion that locks with the lock portion is formed at the position regulation contacting portion of the operating lever.

6. The connector according to claim 2, wherein a slip-out preventing projection for contacting the cam portion of the operating lever for position regulation is formed between the slip-out preventing projection and the turning recessed portion of the connection terminal and at a position adjacent to the turning recessed portion.

7. The connector according to claim 2, wherein a plurality of position regulating contacting portions juxtaposed at the operating lever are coupled and integrated to be continuous on a same axis center.

8. The connector according to claim 3, wherein a plurality of position regulating contacting portions juxtaposed at the operating lever are coupled and integrated to be continuous on a same axis center.

9. The connector according to claim 2, wherein a lock portion is arranged at the slip-out preventing projection of the connection terminal and a lock receiving portion that locks with the lock portion is formed at the position regulation contacting portion of the operating lever.

10. The connector according to claim 3, wherein a lock portion is arranged at the slip-out preventing projection of the connection terminal and a lock receiving portion that locks with the lock portion is formed at the position regulation contacting portion of the operating lever.

11. The connector according to claim 4, wherein a lock portion is arranged at the slip-out preventing projection of the connection terminal and a lock receiving portion that locks with the lock portion is formed at the position regulation contacting portion of the operating lever.

* * * * *